United States Patent [19]

Swartzbaugh

[11] Patent Number: 4,623,077

[45] Date of Patent: Nov. 18, 1986

[54] DISPENSING CLOSURE VALVE

[75] Inventor: Peter T. Swartzbaugh, Toledo, Ohio

[73] Assignee: Owens-Illinois, Inc., Toledo, Ohio

[21] Appl. No.: 589,630

[22] Filed: Mar. 15, 1984

[51] Int. Cl.[4] ..... B65D 47/00

[52] U.S. Cl. ..... 222/517; 222/556

[58] Field of Search ..... 222/563, 544, 501, 556, 222/508, 505, 498, 511, 517, 531, 534, 533

[56] References Cited

U.S. PATENT DOCUMENTS

| | | | |
|---|---|---|---|
| 3,157,322 | 11/1964 | Bernhardt | 222/556 |
| 3,168,226 | 2/1965 | Underwood et al. | 222/556 |
| 3,752,371 | 8/1973 | Susuki et al. | 222/517 |
| 3,972,452 | 8/1976 | Welsh | 222/501 |
| 4,444,340 | 4/1984 | Bond et al. | 222/517 |

FOREIGN PATENT DOCUMENTS

| | | | |
|---|---|---|---|
| 3004119 | 8/1980 | Fed. Rep. of Germany | 222/556 |

*Primary Examiner*—Joseph J. Rolla
*Assistant Examiner*—Kenneth Noland
*Attorney, Agent, or Firm*—John R. Nelson

[57] ABSTRACT

A dispensing closure valve comprising a stem having an annular wall defining an opening. The dispensing closure valve includes a closure including an outer annular wall, an inner annular wall and an integral portion connecting the inner and outer annular walls at the outer end of the closure. The inner annular wall has a transverse wall. The inner wall and transverse wall having a sufficiently thin cross section such that they will flex. A tab integral with the transverse wall extends outwardly from the inner surface thereof for flexing the transverse wall extends outwardly from the inner surface thereof for flexing the transverse wall and inner wall to permit fluid to flow from the opening of said stem. Interengaging portions are provided between the tab and the closure body which are operable upon movement of the tab to open the valve to hold the valve in open position.

9 Claims, 6 Drawing Figures

DISPENSING CLOSURE VALVE

This invention relates to dispensing closure valves for containers and particularly for containers of the flexible wall type.

BACKGROUND OF THE INVENTION

One type of container that is commonly used is of the flexible or bag type commonly known as a "bag in the box" type wherein a dispensing closure valve is attached to the bag for dispensing the contents such as milk or wine.

Such containers are utilized with dispensing closure valves, for example, such as shown in U.S. Pat. Nos. 3,400,866, 3,443,728, 3,972,452 and 4,211,348. These dispensing closure valves consist of a stem or spout attached to the container and a plastic snap-on closure which has a transverse wall in the form of a frustoconical peripheral portion and a flat transverse bottom portion. The peripheral portion seals against portions of the stem. When it is desired to dispense the contents, a tab on the flat portion is manipulated to flex the frustoconical wall portion out of engagement with the stem.

When the tab is manipulated, it must be held in open position as long as the contents are being dispensed. In some instances it is desirable to be able to provide for the valve to be held open without continual pressure on the tab.

Accordingly among the objectives of the present invention are to provide a dispensing valve which includes provision for holding the valve open; which can be made at low cost and in a simple and efficient manner.

In accordance with the invention, interengaging means are provided between the tab and the body to hold the valve in open position.

DESCRIPTION

Figure 1:
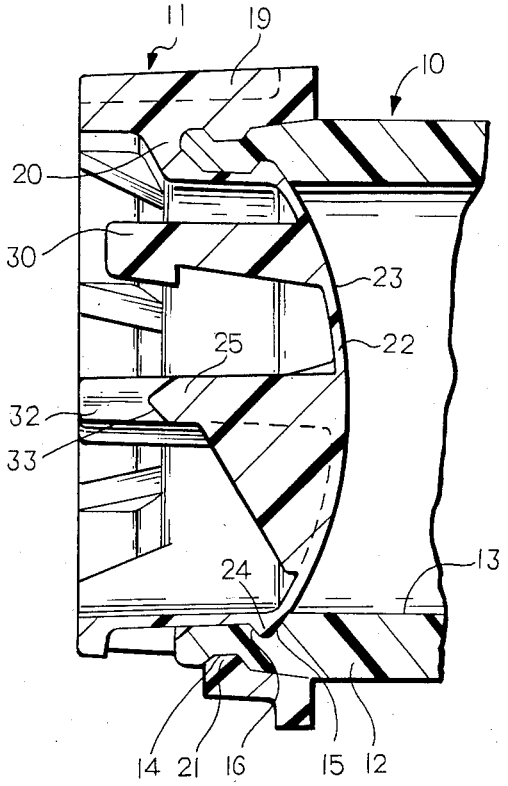
FIG. 1 is a sectional view of a dispensing closure valve embodying the invention.

Referring to FIG. 1, the dispensing closure valve embodying the invention comprises a generally cylindrical stem 10 and a closure 11. The stem is made of thermoplastic material such as low or high density polyethylene (LDPE or PE) and the closure is made of a stretchable elastomeric material such as methacrylate-butadine-styrene (MBS) and possibly a small amount of polyethylene or from butadine-styrene and ethylene vinyl alcohol (EVA) blend which will flex in cross section to permit dispensing of the contents as presently described.

The stem 10 includes an annular wall that is adapted to be connected to a bag in a manner well known in the art. The stem 12 defines an internal cylindrical surface 13. A retaining groove 14 is formed on the outer surface of the stem 10 while a sealing groove 15 is formed on the internal surface 13 of the stem. The groove 15 includes a primary sealing surface 16 that extends radially inwardly and axially outwardly toward the free end of the stem.

Figure 3:
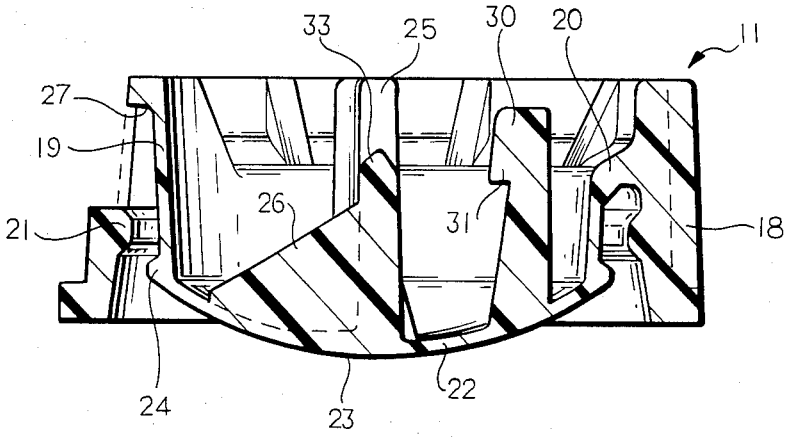
FIG. 3 is a sectional view of the dispensing closure portion of the valve.

As shown in FIG. 3 closure 11 includes an outer annular transverse wall 20 interconnecting the outer wall 18 an inner annular wall 19 and an integral annular transverse wall 20 interconnecting the outer wall 18 and then the inner wall 19. The outer wall 19 includes an annular retaining bead 21 that engages the retaining groove 15. The closure 11 further includes a thin transverse wall 22 that extends across the inner end of the wall 20 and defines a convex surface 23 facing inwardly of the stem 10.

An annular bead 24 at the juncture of the wall 19 and wall 23 engages the groove 16. The bead 25 has a complementary surface to the sealing surface 17.

The space between the surface 17 of the bead 24 and the opposed surface of the bead 21 of the wall 19 is placed under axial tension when the closure is in position urging the sealing surfaces against one another. In addition, the diameter of the wall 19 and diameter of the surface 13 of the stem 10 are such that an interference fit provides a secondary seal.

Figure 2:
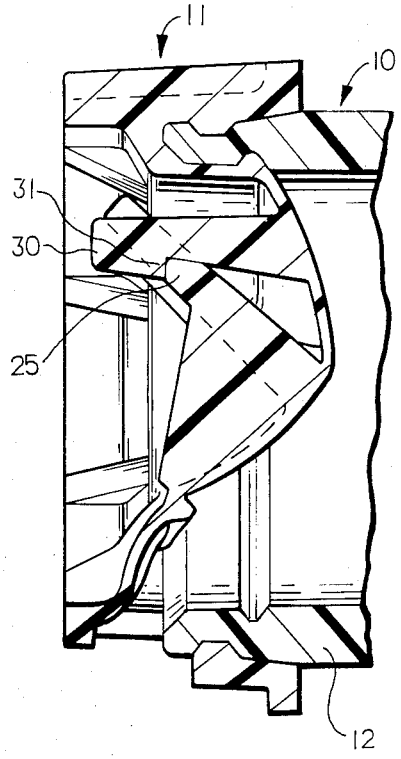
FIG. 2 is a sectional view similar to FIG. 1 showing the functioning of the dispensing closure valve to dispense the contents.

The closure 11 further includes a finger engaged tab 25 that extends axially and integral ribs 26 extending from the actuator to the wall 22 such that when the tab 25 is manipulated as shown in FIG. 2, the walls 19, 22 are flexed permitting the dispensing of the contents through an opening 27 in the outer wall 18 of closure 11.

If an internal pressure is created in the bag by gravity or by dropping or by internal gases such as carbon dioxide, the forces on the convex surface 23 of the wall 22 function to transfer force onto the sealing surface 16. If the internal pressure should be low or even a vacuum, the pretensioning of the wall by the spacing between the surfaces 17, 21 of the locking groove 15 and the sealing groove 16 is such as to insure a seal at low pressure or under vacuum thereby preventing leaks.

In accordance with the invention, interengaging means are provided between the tab 25 and the closure body which engage and hold the tab in position when the tab is moved to a position for holding the valve open.

More specifically, an integral projection 30 is provided on the outer surface of the wall 22 and extends generally axially and in parallel relationship to the tab 25. The projection 30 includes a notch 31 facing the wall 22 and the tab 25 is provided with a slot 32 so that when the tab 25 is pivoted to the position shown in FIG. 2 the bottom 33 of the slot engages beneath the notch 31 and the sides of the slot frictionally engage the projection to hold the valve in open position. In order to release the valve, the projection 30 is flexed away from the tab 25 permitting the elasticity of the tab 25 to return the tab 25 and, in turn, the wall 22 into closed position.

Figure 5:
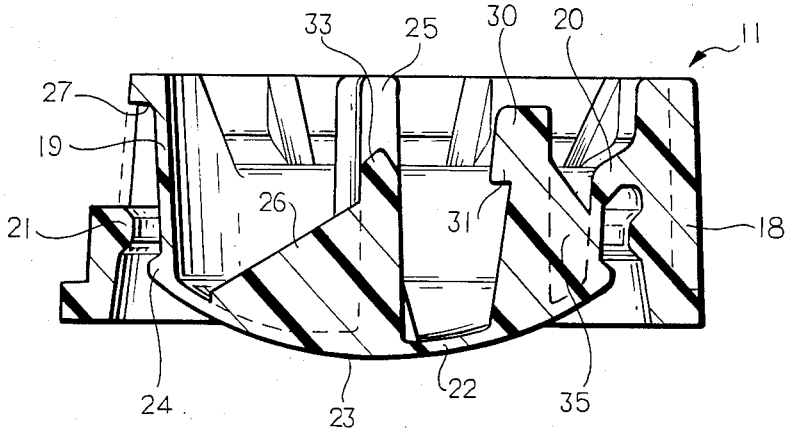
FIG. 5 is a sectional view of a modified form of dispensing closure.
Figure 6:
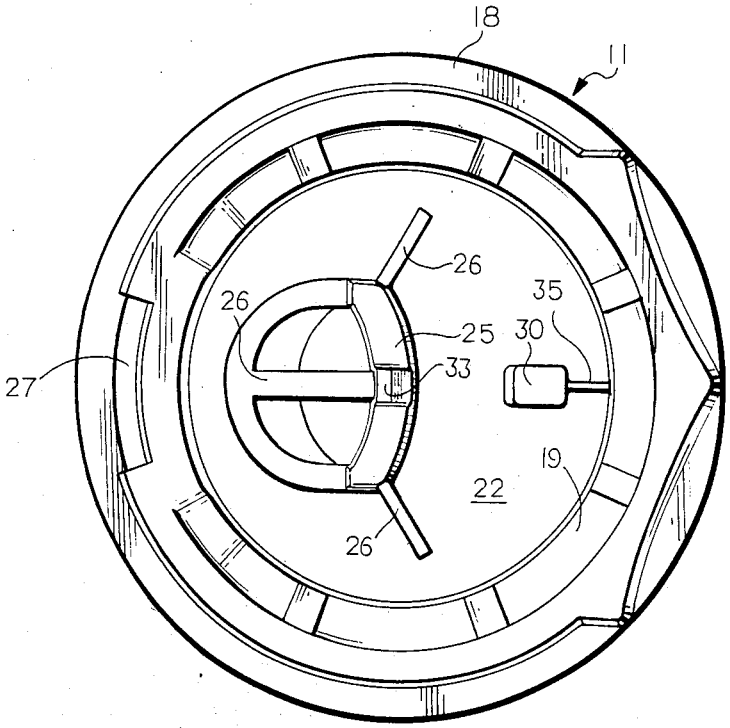
FIG. 6 is a plan view of the dispensing closure shown in FIG. 5.

In the modified form of the invention shown in FIGS. 5 and 6, one or more integral webs or ribs 35 are provided between projection 30 in order to stiffen the projection 30.

Figure 4:
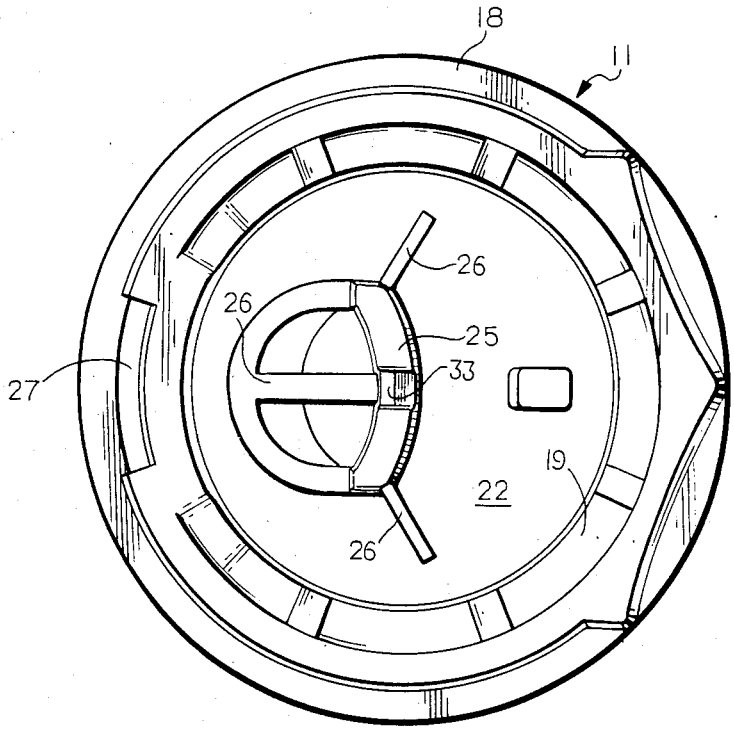
FIG. 4 is a plan view of the dispensing closure.

In each form, the finger engaged tab 25 is arcuate as viewed in FIGS. 4 and 6 with the pulling rib **26*a* extending in one direction and tilting ribs 26*b*** extending laterally.

It can thus be seen that there has been provided a means for holding the valve in open position which is readily obtained, is simple in construction and low in cost.

I claim:

1. A dispensing closure valve for a container comprising a stem for attachment to the container, said stem having an annular wall defining an opening, and a closure made of plastic material such that it will flex in thin cross section, said closure having an annular wall and a radial wall engaging the free end of said stem, and a transverse wall facing inwardly of the container, said closure and said stem having interengaging sealing surfaces, an actuator comprising a tab extending axially from the inner surface of a portion of the transverse wall providing a handle portion for manipulation of the closure to flex a portion only of the axial wall and a portion only of the transverse wall and thereby permit the contents to flow between the wall of the stem and the wall of the container, means on the tab and means on the remaining portion of the transverse wall of said closure mechanically interengaging the tab and the transverse wall of the closure operable upon movement of the tab in a direction to open the valve to mechanically interengage one another and to hold the valve in open position.

2. The dispensing valve set forth in claim 1 wherein said interengaging means between said tab and said closure extends from said body and engages said tab.

3. The dispensing valve set forth in claim 2 wherein said interengaging means comprises an integral projection from the transverse wall and has a free end mechanically interengaging with said tab.

4. The dispensing closure valve set forth in claim 1 including a stiffening rib extending between said tab and said body.

5. A dispensing closure valve for a container comprising a stem for attachment to the container, said stem having an annular wall defining an opening, and a closure made of plastic material such that it will flex in thin cross section, said closure having an annular wall and a radial wall engaging the free end of said stem, and a transverse wall facing inwardly of the container, said closure and said stem having interengaging sealing surfaces, an actuator comprising a tab extending axially from the inner surface of the transverse wall providing a handle portion for manipulation of the closure to flex the axial wall and the transverse wall and thereby permit the contents to flow between the wall of the stem and the wall of the container, interengaging means between the tab and the transverse wall of the closure operable upon movement of the tab in a direction to open the valve to hold the valve in open position, said interengaging means between said tab and said closure extending from said body and engaging said tab, said interengaging means comprising an integral projection extending from the transverse wall and having a free end interengaging with said tab, said tab including a slot defining spaced members, said projection frictionally engaging said spaced members.

6. The dispensing valve set forth in claim 5 wherein said projection includes a notch, said notch engaging the base of the said slot in said tab.

7. The dispensing valve set forth in claim 5 including circumferentially spaced ribs extending from said actuator to said transverse wall.

8. The dispensing valve set forth in claim 7 wherein said actuator has an arcuate finger engaging portion.

9. The dispensing closure valve set forth in claim 8 wherein said tab is a portion of said transverse wall and said integral projection is on another portion of said transverse wall which does not flex.

* * * * *